US010167619B2

(12) United States Patent
Yaoka et al.

(10) Patent No.: US 10,167,619 B2
(45) Date of Patent: Jan. 1, 2019

(54) URINAL WITH SEPARATE WATER SUPPLYING AND WATER SPRAYING DEVICES

(71) Applicant: TOTO, Ltd., Kitakyushu-shi, Fukuoka (JP)

(72) Inventors: Toshinari Yaoka, Kitakyushu (JP); Yoichi Murase, Kitakyushu (JP); Yuichi Furuta, Kitakyushu (JP); Satoshi Matsunaka, Kitakyushu (JP); Yusuke Araki, Kitakyushu (JP); Yusuke Nakamura, Kitakyushu (JP); Masahiro Yamamoto, Kitakyushu (JP); Aiko Itami, Kitakyushu (JP)

(73) Assignee: TOTO, Ltd., Kitakyushi-shi, Fukuoka (JP)

( * ) Notice: Subject to any disclaimer, the term of this patent is extended or adjusted under 35 U.S.C. 154(b) by 0 days.

(21) Appl. No.: 14/668,370

(22) Filed: Mar. 25, 2015

(65) Prior Publication Data

US 2015/0275496 A1 Oct. 1, 2015

(30) Foreign Application Priority Data

Mar. 26, 2014 (JP) ..... 2014-064155
Mar. 26, 2014 (JP) ..... 2014-064156
Mar. 26, 2014 (JP) ..... 2014-064157

(51) Int. Cl.
*E03D 13/00* (2006.01)

(52) U.S. Cl.
CPC ..... *E03D 13/00* (2013.01); *E03D 2201/40* (2013.01)

(58) Field of Classification Search
CPC ..... E03D 13/00; E03D 13/002; E03D 13/005; E03D 13/007; E03D 5/10; E03D 5/105; E03D 5/125; E03D 5/022
(Continued)

(56) References Cited

U.S. PATENT DOCUMENTS 543,945 A * 8/1895 Bormann ..... E03D 5/08 239/523
779,904 A * 1/1905 Putnam ..... E03D 13/00 4/310
(Continued)

FOREIGN PATENT DOCUMENTS

CN 201474044 U 5/2010
DE 2062929 A1 * 7/1971 ..... E03D 13/00
(Continued)

OTHER PUBLICATIONS

JP '741 Machine Translation.*
(Continued)

*Primary Examiner* — Erin Deery
(74) *Attorney, Agent, or Firm* — Banner & Witcoff, Ltd.

(57) ABSTRACT

To provide a urinal apparatus, including: a water supplying device configured to supply water to a bowl section of a urinal; a trap section provided in a lower part of the bowl section and configured so that urine and water flow into the trap section; and a water sprinkling device configured to sprinkle water droplets to a region inside the bowl section, the region being located between the trap section and position of a nose of a user facing the bowl section, wherein the timing of sprinkling the water droplets by the water sprinkling device being different from timing of supplying water by the water supplying device.

9 Claims, 11 Drawing Sheets

(58) Field of Classification Search
USPC ..... 4/301–311
See application file for complete search history.

(56) References Cited

U.S. PATENT DOCUMENTS

| | | | | |
|---|---|---|---|---|
| 6,862,754 | B1 | 3/2005 | DeMarco | |
| 8,136,174 | B2 * | 3/2012 | Ito | E03D 5/105 4/302 |
| 8,561,219 | B2 * | 10/2013 | Metcalf | E03D 11/12 4/307 |
| 2005/0039248 | A1 | 2/2005 | DeMarco | |
| 2010/0064425 | A1 | 3/2010 | Ito | |
| 2011/0061692 | A1 * | 3/2011 | Gopalan | B05B 1/08 134/169 R |
| 2012/0144572 | A1 * | 6/2012 | Bush | E03D 11/08 4/420 |
| 2014/0059757 | A1 | 3/2014 | Hamakita et al. | |
| 2014/0165277 | A1 * | 6/2014 | Schmed | E03D 9/005 4/309 |

FOREIGN PATENT DOCUMENTS

| | | | | |
|---|---|---|---|---|
| DE | 102011052369 | A1 * | 2/2013 | E03D 9/005 |
| EP | 2657415 | A1 | 10/2013 | |
| JP | H01-160078 | U | 11/1989 | |
| JP | 05202547 | A * | 8/1993 | |
| JP | 06136799 | A * | 5/1994 | |
| JP | 06136800 | A * | 5/1994 | |
| JP | 06212681 | A * | 8/1994 | |
| JP | 07207741 | A * | 8/1995 | |
| JP | H09-144103 | A | 6/1997 | |
| JP | H09-221807 | A | 8/1997 | |
| JP | 2009-138359 | A | 6/2009 | |
| JP | 2013-224548 | A | 10/2013 | |
| JP | 2013224548 | A | 10/2013 | |
| TW | 201402916 | A | 1/2014 | |
| WO | 2012/133298 | A1 | 10/2012 | |

OTHER PUBLICATIONS

Machine Translation of JPH01160078.*

Nov. 6, 2017—(JP) Notificaton of Reasons for Refusal—App 2014-064155, Eng Tran.

Nov. 6, 2017—(JP) Notificaton of Reasons for Refusal—App 2014-064156, Eng Tran.

* cited by examiner

URINAL WITH SEPARATE WATER SUPPLYING AND WATER SPRAYING DEVICES

CROSS-REFERENCE TO RELATED APPLICATIONS

This application is based upon and claims the benefit of priorities from Japanese Patent Application No. 2014-064155, filed on Mar. 26, 2014, Japanese Patent Application No. 2014-064156, filed on Mar. 26, 2014, and Japanese Patent Application No. 2014-064157, filed on Mar. 26, 2014; the entire contents of which are incorporated herein by reference.

BACKGROUND

The odor generated from a urinal apparatus fails to be sufficiently removed by flushing the bowl section of the urinal apparatus with water. Thus, various deodorization devices for removing the odor of a urinal apparatus have been proposed. Urine remaining in the urinal apparatus is decomposed by common bacteria to generate ammonia. This is considered to be the main source of the odor of the urinal apparatus. Specifically, urine remaining inside the trap of the urinal apparatus is decomposed by enzymes to generate ammonia ions and ammonia gas.

Under application of energy (such as heat and water flow) by urination, ammonia ions turn to ammonia gas. When a temperature difference occurs by urination, the ammonia gas is carried on an updraft and reaches the position of the user's nose. Thus, the ammonia gas generated in several seconds after urination reaches the position of the user's nose. This causes the user to feel an unpleasant odor.

As a countermeasure for removing the odor of a urinal apparatus, Japanese Patent No. 3480173 proposes a toilet stool unit with sterilizing water feed function. In this toilet stool unit, generation of the odor from ammonia and the like is suppressed by sterilizing common bacteria. However, it is difficult to completely sterilize common bacteria. In this regard, the toilet stool unit with sterilizing water feed function disclosed in Japanese Patent No. 3480173 has room for improvement.

On the other hand, Japanese Utility Model Registration No. 3081605 discloses a male urinal flushing device. In this device, the flush valve is operated with a cartridge in a hole. Then, the detergent in the cartridge partly dissolves into the flush water flowing into the cavity and flows out from sprinkling holes into the urine receptacle. However, the male urinal flushing device disclosed in Japanese Utility Model Registration No. 3081605 supplies detergent into the male urinal together with flush water when flushing the male urinal. Thus, it cannot suppress that urine remaining in the male urinal after use of the male urinal is decomposed by common bacteria to generate ammonia.

Furthermore, when flushing the bowl section of a urinal, it is necessary to remove foreign matter such as urine and hair attached to the surface of the bowl section, and to replace the seal water in the trap section. Thus, it is necessary to pass a relatively large amount of water at a relatively fast flow velocity. Accordingly, two regions are produced on the bowl section in order to suppress water splashing out of the bowl section. One region of the bowl section is supplied with water, and the other region of the bowl section is not supplied with water. Urine attached to the region of the bowl section not supplied with water remains fixed without being flushed with water supplied to the bowl section. Thus, the region of the bowl section not supplied with water acts as a source of the odor.

SUMMARY

According to an aspect of the present invention, a urinal apparatus includes: a water supplying device configured to supply water to a bowl section of a urinal; a trap section provided in a lower part of the bowl section and configured so that urine and water flow into the trap section; and a water sprinkling device configured to sprinkle water droplets to a region inside the bowl section, the region being located between the trap section and position of a nose of a user facing the bowl section, timing of sprinkling the water droplets by the water sprinkling device being different from timing of supplying water by the water supplying device.

DETAILED DESCRIPTION

Figure 1:
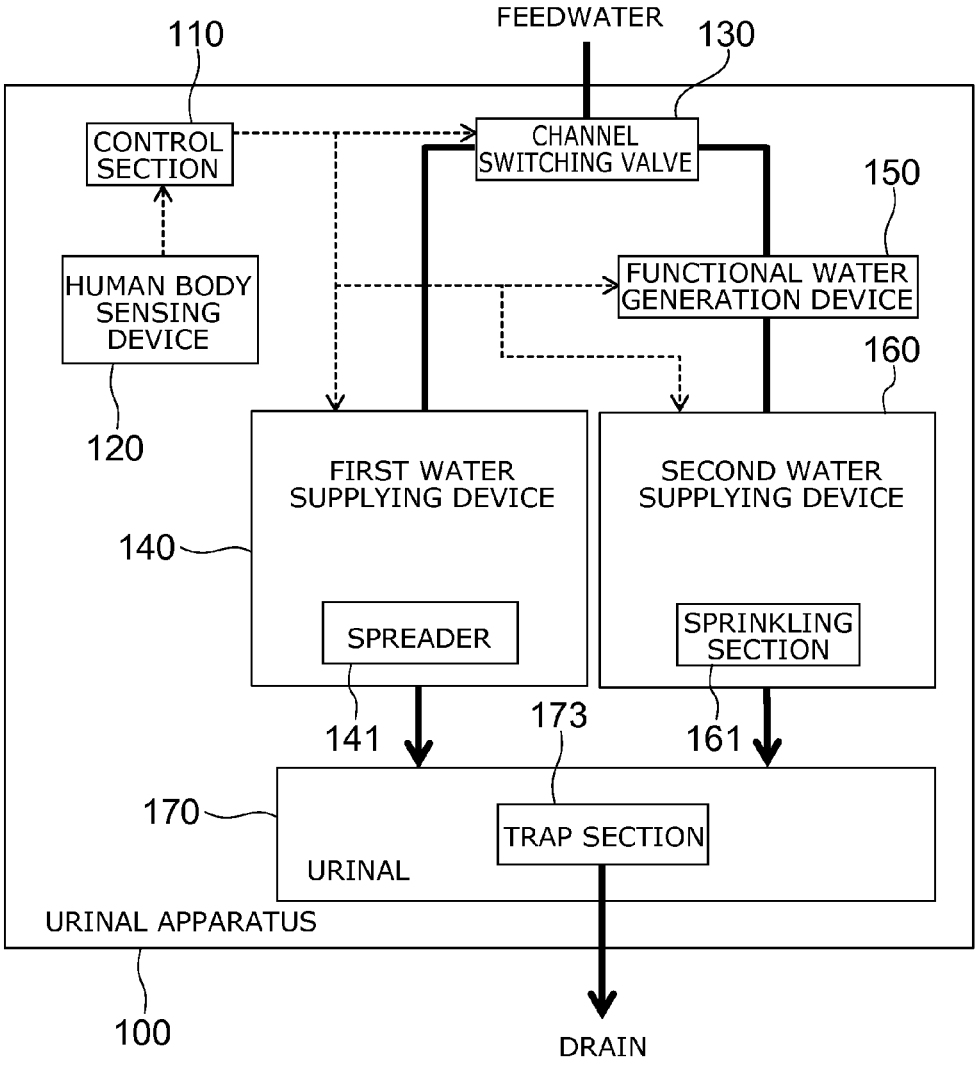
FIG. 1 is a block diagram showing the main configuration of a urinal apparatus according to an embodiment of the invention.

A first aspect of the invention is a urinal apparatus comprising a water supplying device configured to supply water to a bowl section of a urinal, a trap section provided in a lower part of the bowl section and configured so that urine and water flow into the trap section, and a water sprinkling device configured to sprinkle water droplets to a region inside the bowl section. The region is located between the trap section and position of a nose of a user facing the bowl section. The timing of sprinkling the water droplets by the water sprinkling device is different from the timing of supplying water by the water supplying device.

In this urinal apparatus, the water supplying device flushes the bowl section of the urinal. The water sprinkling device sprinkles water droplets to dissolve ammonia generated from the trap section. This can suppress that the user feels the odor of ammonia generated from the trap section. Furthermore, this urinal apparatus can efficiently suppress the odor of ammonia generated from the urinal.

A second aspect of the invention is a urinal apparatus according to the first aspect, wherein the water sprinkling device includes a sprinkling section provided in an upper part of the bowl section. The sprinkling section sprinkles the water droplets downward to the bowl section.

In this urinal apparatus, the sprinkling section sprinkles water droplets downward to the bowl section. This generates an air flow directed downward from the sprinkling section inside the bowl section. Thus, the air flow generated inside the bowl section can suppress updraft of ammonia. Furthermore, the water sprinkled from the sprinkling section dissolves ammonia. This can suppress that the user feels the odor of ammonia generated from the urinal.

Furthermore, sprinkling water droplets can suppress the odor of ammonia near the ammonia source located on the surface of the bowl section. In addition, the droplets passing through the space can also suppress the odor of ammonia existing in the space. Furthermore, the surface area of water per unit amount of water can be made significantly larger in the water droplets than in the state of water moving on the surface of the bowl section. This can increase the area of water in contact with ammonia to efficiently suppress the odor. The odor existing in the space includes not only that of ammonia originating from urine, but also the odor of urine itself urinated by the user (e.g., the odor derived from ingested food such as a coffee odor). The latter odor can also be suppressed by sprinkling water droplets.

A third aspect of the invention is a urinal apparatus according to the first aspect, wherein the water sprinkling device includes a sprinkling section provided in a lower part of the bowl section. The sprinkling section sprinkles the water droplets upward to the bowl section.

In this urinal apparatus, the sprinkling section sprinkles water droplets upward to the bowl section. Thus, at least part of the water sprinkled from the sprinkling section can drift outside the bowl section. The water drifting outside the bowl section can dissolve ammonia gas existing outside the bowl section. This makes the user less likely to feel the odor around the urinal as well as the odor of the urinal.

A fourth aspect of the invention is a urinal apparatus according to the first aspect, further comprising a human body sensing device configured to sense a user located before the urinal. When the human body sensing device senses the user, the water sprinkling device sprinkles the water droplets.

In this urinal apparatus, the water sprinkling device can sprinkle water to the bowl section and suppress the odor of ammonia gas before the user approaches the urinal and feels the odor of ammonia gas.

A fifth aspect of the invention is a urinal apparatus comprising a water supplying device configured to supply water to a bowl section of a urinal, and a water sprinkling device configured to sprinkle water droplets downward from an upper part of the bowl section. The water droplet has a diameter of 10 micrometers or more and 1200 micrometers or less.

In this urinal apparatus, the water supplying device flushes the bowl section of the urinal. The water sprinkling device sprinkles water droplets to dissolve suspended ammonia gas. This can suppress that the user feels the odor of ammonia gas. Furthermore, the diameter of the water droplet is 10 micrometers or more. Thus, the droplets remain suspended in the space to a lesser extent. Accordingly, splashing to any unintended space can be suppressed. This can suppress that the droplets sprinkled from the water sprinkling device wet the user and the surroundings of the urinal. Furthermore, the diameter of the water droplet is 1200 micrometers or less. This can suppress decreasing the effect of dissolving ammonia because the droplets sprinkled from the water sprinkling device fall relatively fast.

Furthermore, sprinkling water droplets can suppress the odor of ammonia near the ammonia source located on the surface of the bowl section. In addition, the droplets passing through the space can also suppress the odor of ammonia existing in the space. Furthermore, the surface area of water per unit amount of water can be made significantly larger in the water droplets than in the state of water moving on the surface of the bowl section. This can increase the area of water in contact with ammonia to efficiently suppress the odor. The odor existing in the space includes not only that of ammonia originating from urine, but also the odor of urine itself urinated by the user (e.g., the odor derived from ingested food such as a coffee odor). The latter odor can also be suppressed by sprinkling water droplets.

A sixth aspect of the invention is a urinal apparatus according to the fifth aspect, wherein the water sprinkling device includes a sprinkling section provided in the upper part. The water sprinkled by the sprinkling section is shaped like a cone or a sector. The water sprinkled by the sprinkling section ranges inside the bowl section.

This urinal apparatus suppresses that the water sprinkled from the sprinkling section is attached to the outside of the bowl section. This can suppress that the water sprinkled from the sprinkling section wets the user and the surroundings of the urinal.

A seventh aspect of the invention is a urinal apparatus according to the sixth aspect, wherein the cone or the sector has an axis directed behind the urinal as viewed from the sprinkling section.

This urinal apparatus can further suppress that the water sprinkled from the sprinkling section wets the user and the surroundings of the urinal. Furthermore, urine may be attached to the region not flushed with water supplied from the water supplying device. Even in this case, the water sprinkling device can flush the urine attached to the surface of the bowl section with water sprinkled from the sprinkling section. This can suppress the odor of ammonia generated from the urinal.

An eighth aspect of the invention is a urinal apparatus according to the fifth aspect, wherein the water sprinkled by the water sprinkling device is functional water capable of decomposing ammonia.

In this urinal apparatus, the functional water can dissolve and decompose ammonia. This can suppress regeneration of the odor of ammonia even when e.g. water dissolved with ammonia is attached to and evaporated from the surroundings of the urinal.

A ninth aspect of the invention is a urinal apparatus comprising a first water supplying device configured to supply water to a bowl section of a urinal, and a second water supplying device configured to supply water in a smaller amount than the water supplied by the first water supplying device to at least part of a region of the bowl section not flushed with the water supplied by the first water supplying device.

In this urinal apparatus, the second water supplying device supplies water to at least part of the region of the bowl section not flushed with the water supplied by the first water supplying device. This can suppress the odor of ammonia generated from urine attached to the region of the bowl section not flushed with the water supplied by the first water supplying device. Thus, the odor of ammonia generated from the urinal can be suppressed. Furthermore, this can flush the region of the bowl section not flushed with the water supplied by the first water supplying device. Furthermore, the second water supplying device supplies water in a smaller amount than the water supplied by the first water supplying device. Thus, the region of the bowl section not flushed with the water supplied by the first water supplying device can be efficiently flushed with a relatively small amount of water. This can save water.

A tenth aspect of the invention is a urinal apparatus according to the ninth aspect, wherein the second water supplying device includes a spreader configured to supply water to the bowl section, and the region includes a lateral side of the spreader.

Urination by the user is acted on the horizontal central region of the bowl section so that urine does not splash from the bowl section. Thus, a large amount of urine from users is entirely attached to the region directly below the spreader installed on the upper part of the horizontal central region of the bowl section of the urinal. A large amount of water is entirely supplied from the first water supplying device to the region directly below the spreader to flush urine from the bowl section. This can suppress generation of ammonia gas originating from urine. On the other hand, splash of urine from users is locally attached to the region including the lateral side of the spreader. A small amount of water is locally supplied from the second water supplying device to the region including the lateral side of the spreader to flush urine from the bowl section. This can suppress generation of ammonia gas originating from urine while saving water. Here, the region including the lateral side of the spreader refers to not only the horizontally lateral side of the spreader. The region refers to a region of the bowl section around the spreader except the region of the bowl section flushed with the first water supplying device.

An eleventh aspect of the invention is a urinal apparatus according to the ninth aspect, wherein the region includes a tip part of a lip section of the urinal.

The tip part of the lip section of the urinal is relatively prone to attachment of urine.

This urinal apparatus can flush the region of the bowl section relatively prone to attachment of urine and not flushed with the water supplied by the first water supplying device. This can suppress the odor of ammonia generated from the urinal.

A twelfth aspect of the invention is a urinal apparatus according to the ninth aspect, wherein the water supplied from the second water supplying device and moving on a surface of the bowl section has a slower speed than the water supplied from the first water supplying device and moving on the surface of the bowl section.

In this urinal apparatus, the second water supplying device flushes dirt on the surface of the bowl section with water in a relatively small flow rate. Thus, the bowl section can be efficiently flushed. This can suppress the odor of ammonia generated from the urinal.

A thirteenth aspect of the invention is a urinal apparatus according to the ninth aspect, wherein the second water supplying device supplies water droplets to the bowl section.

In this urinal apparatus, the second water supplying device can sprinkle water droplets and efficiently flush the surface of the bowl section. This can further suppress the odor of ammonia generated from the urinal. Furthermore, sprinkling water droplets can suppress the odor of ammonia near the ammonia source located on the surface of the bowl section. In addition, the droplets passing through the space can also suppress the odor of ammonia existing in the space. Furthermore, the surface area of water per unit amount of water can be made significantly larger in the water droplets than in the state of water moving on the surface of the bowl section. This can increase the area of water in contact with ammonia to efficiently suppress the odor. The odor existing in the space includes not only that of ammonia originating from urine, but also the odor of urine itself urinated by the user (e.g., the odor derived from ingested food such as a coffee odor). The latter odor can also be suppressed by sprinkling water droplets.

Embodiments of the invention will now be described with reference to the drawings. In the drawings, similar components are labeled with like reference numerals, and the detailed description thereof is omitted appropriately.

FIG. 1 is a block diagram showing the main configuration of a urinal apparatus according to an embodiment of the invention. In FIG. 1, the main configurations of the water channel system and the electrical system are shown in combination.

The urinal apparatus 100 according to this embodiment includes a first water supplying device 140, a second water supplying device (ammonia dissolution device, water sprinkling device) 160, and a urinal 170. The urinal apparatus 100 according to this embodiment may include a control section 110, a human body sensing device 120, a channel switching valve 130, and a functional water generation device 150.

The urinal 170 is a male urinal. The urinal 170 includes a bowl section 171 (see FIGS. 2 and 3) and a trap section 173 (see FIG. 5A). The trap section 173 is provided in the lower part of the bowl section 171. The trap section 173 forms seal water inside the trap section 173 itself. Thus, the trap section 173 can prevent e.g. foul odors and pests from intruding into e.g. the toilet room from e.g. the horizontal drain piping, not shown, provided behind the urinal apparatus 100. Urine and water flow into the trap section 173.

The channel switching valve 130 is switched between the following two states based on the signal transmitted from the control section 110. In the first state, water supplied from the feedwater source (such as waterworks and tank), not shown, is guided to the first water supplying device 140. In the second state, water supplied from the feedwater source is guided to the second water supplying device 160.

The first water supplying device 140 includes a spreader 141. By the first water supplying device 140, water supplied from the feedwater source through the channel switching valve 130 is supplied to the bowl section 171 of the urinal 170.

The second water supplying device 160 includes a sprinkling section 161. By the second water supplying device 160, water supplied from the feedwater source through the channel switching valve 130 and turned into water droplets is supplied from the sprinkling section 161 to the bowl section 171 of the urinal 170. The water supplied from the sprinkling section 161 to the bowl section 171 of the urinal 170 can dissolve ammonia. The diameter of the water droplets sprinkled by the second water supplying device 160 is e.g. approximately 10 micrometers (μm) or more and 1200 μm or less. The details of the diameter of the water droplets sprinkled by the second water supplying device 160 will be described later.

Here, the mechanism of the generation of ammonia is e.g. as follows.

After urination into the toilet bowl, urine is attached to the surface of the toilet bowl, or retained in the seal water (retention water) of the trap section. Common bacteria existing in the air or on e.g. the toilet bowl surface are attached to the retained urine. The common bacteria absorb nutrition from urine. This activates the activity of producing urease enzyme. The urease enzyme promotes the decomposition of urea. Urea is decomposed into ammonia and carbon dioxide. This ammonia causes a foul odor. Furthermore, the generated ammonia shifts the hydrogen ion concentration (pH) of the decomposition product to alkalinity. If pH is shifted to alkalinity beyond 8.0 to 8.5, calcium ions dissolved in urine are turned into poorly soluble calcium compounds (such as calcium phosphate, also commonly referred to as urinary calculus). This urinary calculus incubates bacteria and repeats the foregoing process in an accelerated manner. Thus, ammonia is further generated.

The functional water generation device 150 can generate functional water from the water supplied from the feedwater source through the channel switching valve 130 based on the signal transmitted from the control section 110. The functional water can dissolve and decompose ammonia.

For instance, the functional water generation device 150 includes therein an anode plate, not shown, and a cathode plate, not shown. The functional water generation device 150 can electrolyze running water or general service water flowing therein based on the signal transmitted from the control section 110. Here, running water contains chloride ions. Chloride ions are contained as e.g. salt (NaCl) and calcium chloride ($CaCl_2$) in the water source (such as groundwater, water in dams, and water in e.g. rivers). Thus, hypochlorous acid is generated by electrolyzing chloride ions. As a result, the water electrolyzed in the functional water generation device 150 (electrolyzed water) is turned into a liquid containing hypochlorous acid (functional water).

Hypochlorous acid functions as a deodorant component or a sterilizing component. The liquid containing hypochlorous acid can dissolve and decompose ammonia, or sterilize common bacteria.

The functional water generation device 150 of this embodiment is not limited to generating a liquid containing hypochlorous acid. The functional water generated in the functional water generation device 150 may be a liquid containing metal ions such as silver ions and copper ions. Alternatively, the functional water generated in the functional water generation device 150 may be a liquid containing e.g. electrolyzed chlorine or ozone. Alternatively, the functional water generated in the functional water generation device 150 may be acidic water or alkaline water. Among them, the solution containing hypochlorous acid can dissolve and decompose ammonia. Furthermore, the functional water generation device 150 is not limited to an electrolytic bath including an anode plate and a cathode plate.

The functional water generation device 150 can generate functional water based on the signal transmitted from the control section 110. In this case, the second water supplying device 160 supplies the functional water generated in the functional water generation device 150 from the sprinkling section 161 to the bowl section 171 of the urinal 170.

On the other hand, the functional water generation device 150 may not generate functional water. In this case, by the second water supplying device 160, the water supplied from the feedwater source through the channel switching valve 130 and the functional water generation device 150 is supplied from the sprinkling section 161 to the bowl section 171 of the urinal 170. Here, the water supplied from the feedwater source is referred to as freshwater. Freshwater is running water or general service water supplied from the feedwater source.

The human body sensing device 120 can sense a user located before the urinal 170, i.e., a user located at a position spaced before the urinal 170. Such a human body sensing device 120 can be e.g. an infrared transmit/receive range sensor, a pyroelectric sensor, or a microwave sensor such as a Doppler sensor.

According to this embodiment, the second water supplying device 160 supplies water to the bowl section 171 of the urinal 170. The water dissolves and decomposes at least one of ammonia generated inside the bowl section 171 and ammonia existing around the bowl section 171. The ammonia existing around the bowl section 171 refers to e.g. ammonia drifting around the bowl section 171 or ammonia suspended around the bowl section 171. Thus, the second water supplying device 160 can suppress the odor of ammonia generated from the urinal apparatus 100. Furthermore, the first water supplying device 140 supplies water to the bowl section 171 of the urinal 170. Thus, the first water supplying device 140 can remove urine attached to the urinal 170 and remove foreign matter such as hair. Furthermore, the first water supplying device 140 supplies water to the trap section 173 of the urinal 170. Thus, the first water supplying device 140 can replace the seal water inside the trap section 173 by the newly supplied water.

The water droplets sprinkled from the second water supplying device 160 efficiently dissolve at least one of ammonia generated inside the bowl section 171 and ammonia existing around the bowl section 171. Thus, in the case where the second water supplying device 160 sprinkles water droplets from the sprinkling section 161 to the bowl section 171 of the urinal 170, the second water supplying device 160 can further suppress the odor of ammonia generated from the urinal apparatus 100.

The functional water sprinkled from the second water supplying device 160 dissolves and decomposes at least one of ammonia generated inside the bowl section 171 and ammonia existing around the bowl section 171. Thus, in the case where the second water supplying device 160 sprinkles functional water, the second water supplying device 160 can suppress regeneration of the odor of ammonia even when e.g. water dissolved with ammonia is attached to and evaporated from the surroundings of the urinal 170.

As described above, the diameter of the water droplets sprinkled by the second water supplying device 160 is approximately 10 μm or more. Thus, the droplets sprinkled from the second water supplying device 160 remain suspended in the space to a lesser extent. Accordingly, splashing to any unintended space can be suppressed. This can suppress that the droplets sprinkled from the second water supplying device 160 we the user and the surroundings of the urinal 170. Furthermore, the diameter of the water droplets sprinkled by the second water supplying device 160 is approximately 1200 μm or less. This can suppress decreasing the effect of dissolving ammonia because the droplets sprinkled from the second water supplying device 160 fall relatively fast.

Here, the definition of the numerical value of the diameter of a water particle is described. The diameter of the water particle sprinkled from the second water supplying device 160 has a certain range in general. The particle diameter of the point at which the distribution curve of the cumulative percentage of the particle diameter crosses the horizontal axis of 50% is referred to as 50% diameter (generally referred to as median diameter). The 50% diameter is used as the diameter of the water particle.

Figure 2:
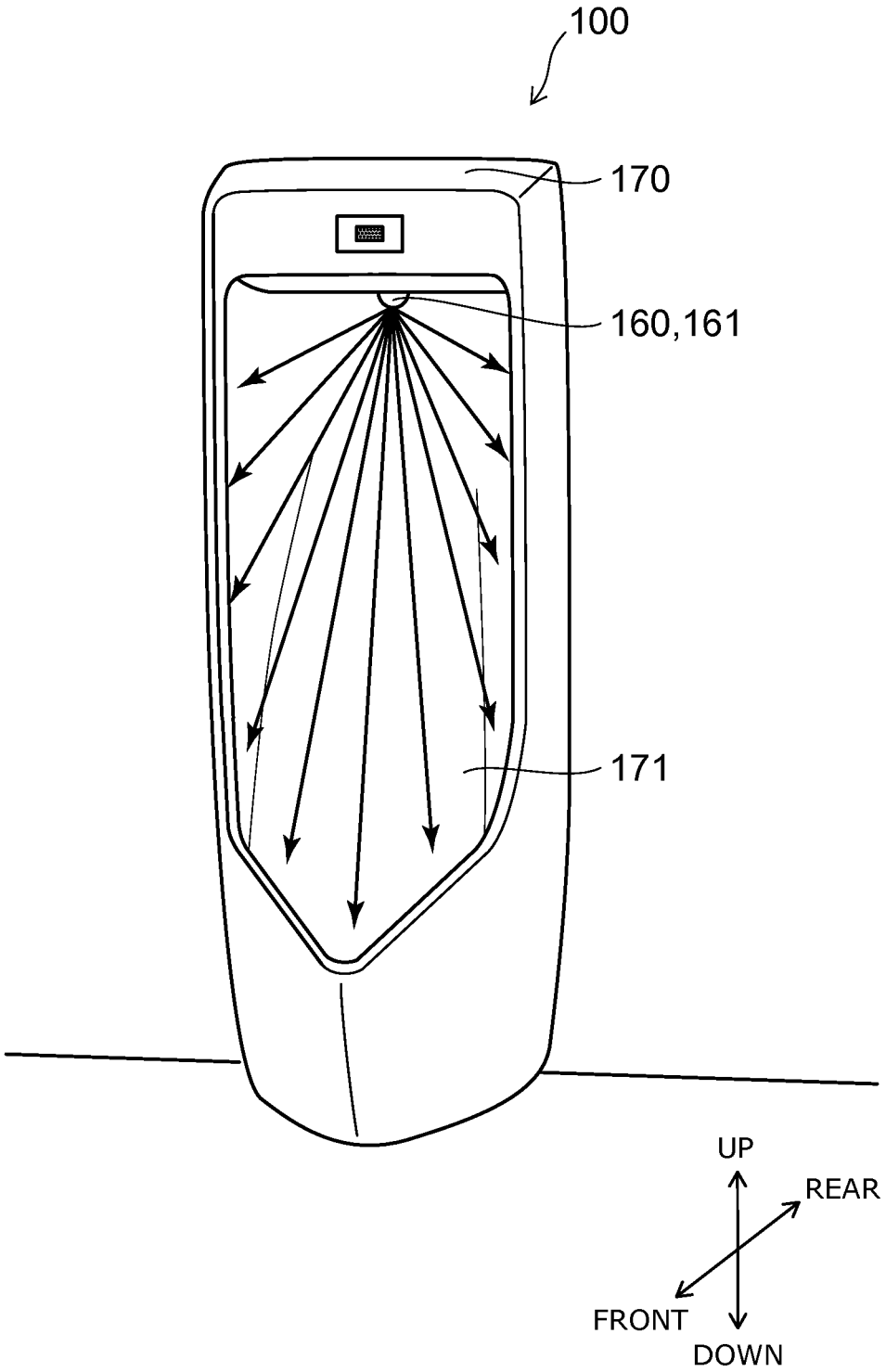
FIG. 2 is a schematic perspective view illustrating an installation configuration of the second water supplying device of this embodiment.

FIG. 2 is a schematic perspective view illustrating an installation configuration of the second water supplying device of this embodiment.

As shown in FIG. 2, for instance, the sprinkling section 161 of the second water supplying device 160 is provided in an upper part of the bowl section 171 of the urinal 170. The sprinkling section 161 sprinkles water droplets downward to the bowl section 171. The term "downward" used herein is not limited to the vertical downward direction, but includes directions below the horizontal direction. That is, the term "downward" used herein refers to a direction except the horizontal direction and the directions above the horizontal direction.

Thus, the sprinkling section 161 sprinkles water droplets downward from the upper part of the bowl section 171. This generates an air flow directed downward from the sprinkling section 161 inside the bowl section 171. Thus, the air flow generated inside the bowl section 171 can suppress updraft of ammonia. Furthermore, the water sprinkled from the sprinkling section 161 dissolves ammonia. Furthermore, the sprinkled water may be functional water containing hypochlorous acid. In this case, the sprinkled water decomposes ammonia into odorless substances in addition to dissolving ammonia. This makes the user less likely to feel the odor of ammonia generated from the urinal apparatus 100.

Furthermore, sprinkling water droplets can suppress the odor of ammonia near the ammonia source located on the surface of the bowl section 171. In addition, the droplets passing through the space can also suppress the odor of ammonia existing in the space. Furthermore, the surface area of water per unit amount of water can be made significantly larger in the water droplets than in the state of water supplied from the first water supplying device 140 and moving on the surface of the bowl section 171. This can increase the area of water in contact with ammonia to efficiently suppress the odor. The odor existing in the space includes not only that of ammonia originating from urine, but also the odor of urine itself urinated by the user (e.g., the odor derived from ingested food such as a coffee odor). The latter odor can also be suppressed by sprinkling water droplets.

Figure 3:
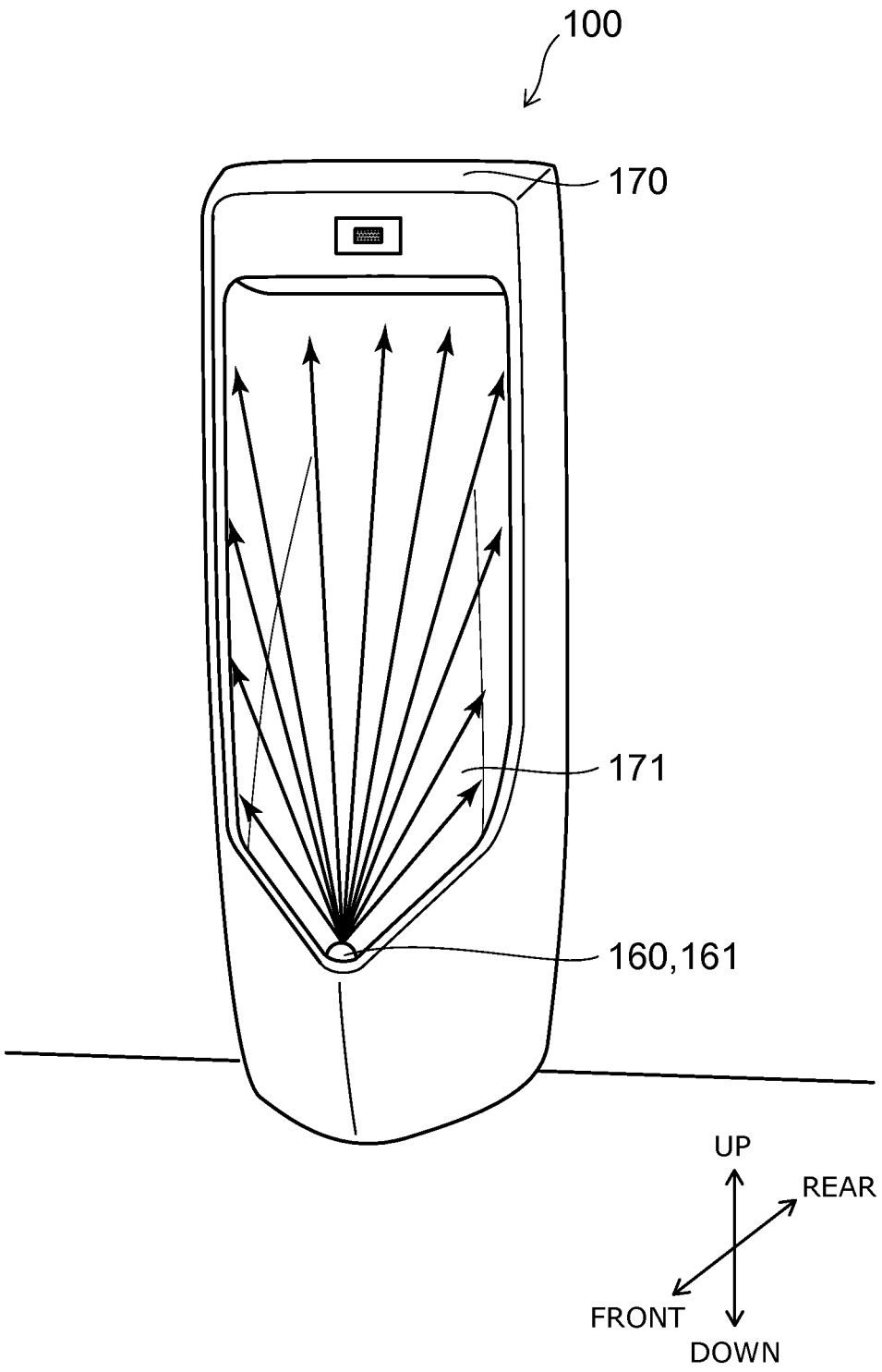
FIG. 3 is a schematic perspective view illustrating an alternative installation configuration of the second water supplying device of this embodiment.

FIG. 3 is a schematic perspective view illustrating an alternative installation configuration of the second water supplying device of this embodiment.

As shown in FIG. 3, for instance, the sprinkling section 161 of the second water supplying device 160 is provided in a lower part of the bowl section 171 of the urinal 170. The sprinkling section 161 sprinkles water droplets upward to the bowl section 171. The term "upward" used herein is not limited to the vertical upward direction, but includes directions above the horizontal direction. That is, the term "upward" used herein refers to a direction except the horizontal direction and the directions below the horizontal direction.

Thus, the sprinkling section 161 sprinkles water droplets upward from the lower part of the bowl section 171. Accordingly, at least part of the water sprinkled from the sprinkling section 161 can drift outside the bowl section 171. The water drifting outside the bowl section 171 can dissolve ammonia gas existing outside the bowl section 171. This makes the user less likely to feel the odor around the urinal 170 as well as the odor of the urinal 170.

Figure 4A:
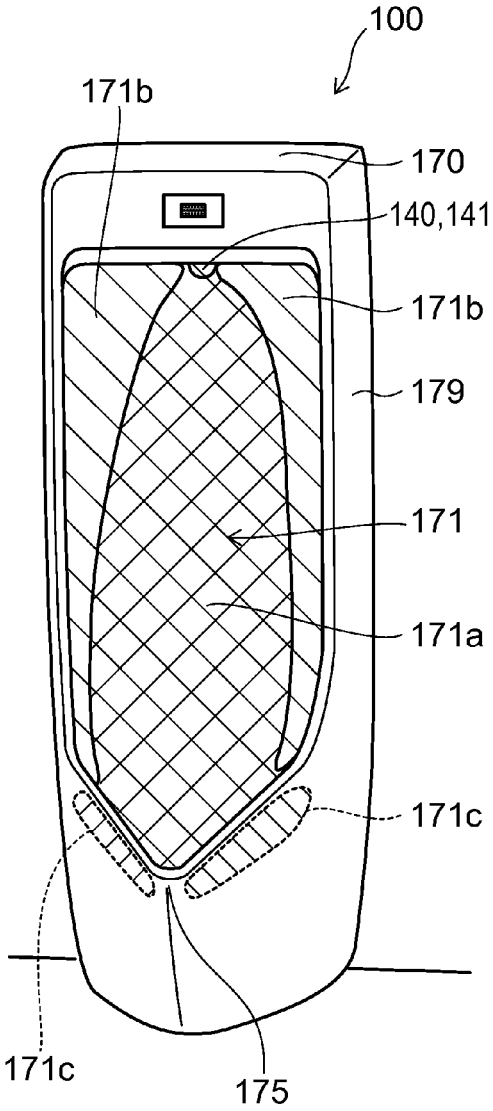
FIGS. 4A and 4B are schematic perspective views showing the region of water supplied to the bowl section of this embodiment.
Figure 4B:
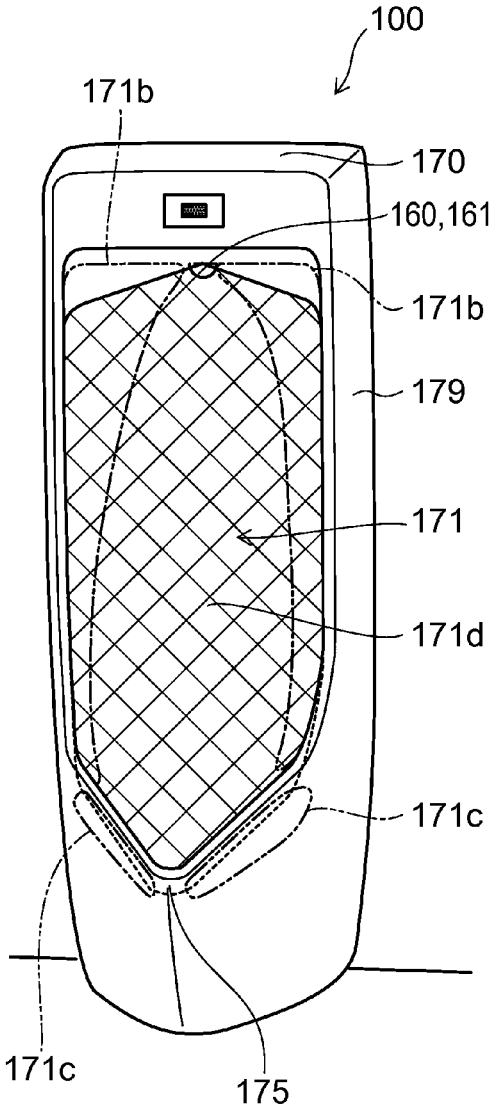

FIGS. 4A and 4B are schematic perspective views showing the region of water supplied to the bowl section of this embodiment.

FIG. 4A is a schematic perspective view showing the region of water supplied to the bowl section 171 from the first water supplying device 140 of this embodiment. FIG. 4B is a schematic perspective view showing the region of water supplied to the bowl section 171 from the second water supplying device 160 of this embodiment.

As shown in FIG. 4A, for instance, the spreader 141 of the first water supplying device 140 is provided in an upper part of the bowl section 171 of the urinal 170. The installation configuration of the spreader 141 is not limited to the example shown in FIG. 4A. As in the first region 171*a* shown in FIG. 4A, the spreader 141 supplies water to a generally central part of the bowl section 171. That is, the first region 171*a* is a region inside the bowl section 171 flushed with water supplied from the spreader 141 of the first water supplying device 140.

There is a second region 171*b* on both left and right sides (lateral sides) of the first region 171*a* inside the bowl section 171. The second region 171*b* is a region inside the bowl section 171 not flushed with water supplied from the spreader 141 of the first water supplying device 140. There is a third region 171*c* on the lip section 175 inside the bowl section 171. Like the second region 171*b*, the third region 171*c* is a region inside the bowl section 171 not flushed with water supplied from the spreader 141 of the first water supplying device 140. In this specification, the "lip section" refers to a portion projected forward from the side surface 179 of the urinal 170.

As illustrated with reference to FIG. 2, for instance, the sprinkling section 161 of the second water supplying device 160 is provided in an upper part of the bowl section 171 of the urinal 170. As in the fourth region 171*d* shown in FIG. 4B, the sprinkling section 161 supplies water generally entirely to the bowl section 171. That is, the fourth region 171*d* is a region inside the bowl section 171, which is a sprinkled region of water supplied from the sprinkling section 161 of the second water supplying device 160. As shown in FIG. 4B, the fourth region 171*d* includes at least part of the second region 171*b*. The fourth region 171*d* includes at least part of the third region 171*c*.

Thus, the second water supplying device 160 can sprinkle and supply water to at least part of the region (second region 171*b* and third region 171*c*) not supplied with water by the first water supplying device 140. This can suppress the odor of ammonia generated from urine attached to the region not supplied with water by the first water supplying device 140. Thus, the odor of ammonia generated from the urinal apparatus 100 can be suppressed. Furthermore, this can flush the region not supplied with water by the first water supplying device 140.

The amount of water supplied to the bowl section 171 in one action by the second water supplying device 160 is smaller than the amount of water supplied to the bowl section 171 in one action by the first water supplying device 140. The amount of water supplied to the bowl section 171 in one action by the second water supplying device 160 is e.g. approximately 20 milliliters (mL) or more and 100 mL or less. The amount of water supplied to the bowl section 171 in one action by the first water supplying device 140 is e.g. approximately 0.4 liters (L) or more and 1.5 L or less.

Thus, the second water supplying device 160 can efficiently flush, with a relatively small amount of water, at least part of the region (second region 171*b* and third region 171*c*) inside the bowl section 171 not flushed with the water supplied from the first water supplying device 140. This can save water.

Urination by the user is acted on the horizontal central region of the bowl section 171 so that urine does not splash from the bowl section 171. Thus, a large amount of urine from users is entirely attached to the region directly below the spreader 141 installed on the upper part of the horizontal central region of the bowl section 171 of the urinal 170. A large amount of water is entirely supplied from the first water supplying device 140 to the region directly below the spreader 141 to flush urine from the bowl section 171. This can suppress generation of ammonia gas originating from urine. On the other hand, splash of urine from users is locally attached to the region including the lateral side of the spreader 141.

In this context, as shown in FIG. 4B, the spreader 141 sprinkles and supplies water near the lateral side of the spreader 141 itself. Thus, the spreader 141 can flush the neighborhood of the lateral side of the spreader 141. Accordingly, the water sprinkled from the spreader 141 can dissolve ammonia gas originating from users' urine locally attached. Alternatively, the water sprinkled from the spreader 141 can flush the surface of the urinal 170 near the spreader 141. This can suppress the odor of ammonia generated from the urinal apparatus 100.

The region not flushed with water supplied from the first water supplying device 140 includes the third region 171*c*. The third region 171*c* includes the tip part of the lip section 175. The lip section 175 is relatively prone to attachment of urine.

In this context, the second water supplying device 160 can sprinkle and supply water to the tip part of the lip section 175. This can suppress the odor of ammonia generated from the urinal apparatus 100.

The water supplied from the first water supplying device 140 to the bowl section 171 flows downward on the surface of the bowl section 171. The water supplied from the second water supplying device 160 to the bowl section 171 and attached to the surface of the bowl section 171 flows downward on the surface of the bowl section 171. At this time, the speed of the water supplied from the second water supplying device 160 to the bowl section 171 and moving on the surface of the bowl section 171 is slower than the speed of the water supplied from the first water supplying device 140 to the bowl section 171 and moving on the surface of the bowl section 171. The water supplied to the bowl section 171 by the second water supplying device 160 consists of water droplets.

Thus, the water supplied from the second water supplying device 160 and moving on the surface of the bowl section 171 can have a longer contact time, and a longer action time on urine, than the water supplied from the first supplying device 140 and moving on the surface of the bowl section 171. Accordingly, the second water supplying device 160 flushes dirt on the surface of the bowl section 171 with water in a relatively small flow rate. Thus, the bowl section 171 can be efficiently flushed. This can suppress the odor of ammonia generated from the urinal apparatus 100.

Figure 5A:
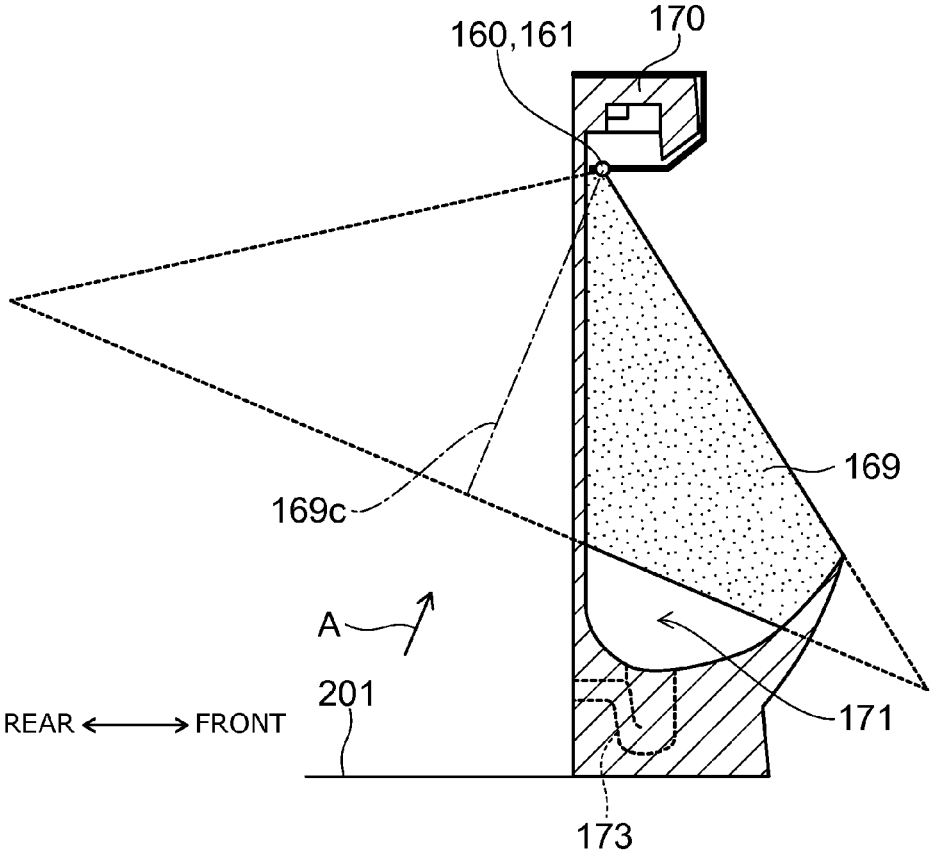
FIGS. 5A and 5B are schematic views describing a shape of water jetted by the second water supplying device of this embodiment.
Figure 5B:
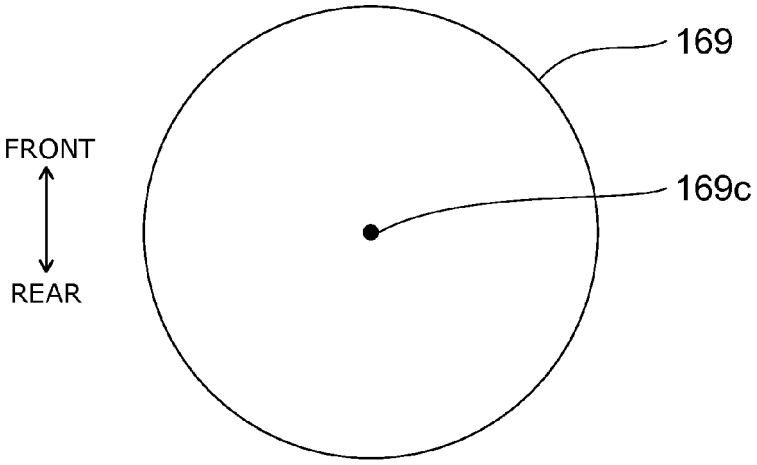

FIGS. 5A and 5B are schematic views describing a shape of water jetted by the second water supplying device of this embodiment.

FIG. 5A is a schematic sectional view of the urinal apparatus of this embodiment as viewed from the lateral side. FIG. 5B is a schematic plan view of water jetted by the second water supplying device as viewed in the direction of arrow A shown in FIG. 5A.

As shown in FIGS. 5A and 5B, the water jetted from the sprinkling section 161 of the second water supplying device 160 has a conical shape 169. As shown in FIG. 5A, the range (sprinkling range) of the water jetted from the sprinkling section 161 of the second water supplying device 160 is fitted inside the bowl section 171. That is, the water sprinkled from the sprinkling section 161 of the second water supplying device 160 does not directly travel to the outside of the bowl section 171.

This suppresses that the water sprinkled from the sprinkling section 161 is attached to the outside of the bowl section 171. This can suppress that the water sprinkled from the sprinkling section 161 wets the user and the surroundings of the urinal 170.

As shown in FIG. 5A, the sprinkling section 161 of the second water supplying device 160 sprinkles water toward the inside of the bowl section 171. In other words, the water sprinkled from the sprinkling section 161 of the second water supplying device 160 is directed toward the inside of the bowl section 171. Specifically, the axis 169*c* of the water of the conical shape 169 sprinkled from the sprinkling section 161 of the second water supplying device 160 is directed backward as viewed from the sprinkling section 161.

This can further suppress that the water sprinkled from the sprinkling section 161 wets the user and the surroundings of the urinal 170. Furthermore, urine may be attached to the region not flushed with water supplied from the first water supplying device 140. Even in this case, the second water supplying device 160 can flush the urine attached to the surface of the bowl section 171 with water sprinkled from the sprinkling section 161. This can suppress the odor of ammonia generated from the urinal apparatus 100.

The sprinkling section 161 sprinkles water droplets to a region inside the bowl section 171 of the urinal 170. The region is located between the trap section 173 and the position of the nose of the user facing the bowl section 171. In this specification, the "position of the nose of the user" refers to a position at a height in the range of approximately 140 centimeters (cm) or more and 170 cm or less from the floor surface 201 of the toilet room in which the urinal apparatus 100 is installed. The urinal apparatus 100 is not necessarily placed on the floor surface 201 of the toilet room. The urinal apparatus 100 may be installed on the wall surface, not shown, of the toilet room. Also in this case, in this specification, the "position of the nose of the user" refers to a position at a height in the range of approximately 140 centimeters (cm) or more and 170 cm or less from the floor surface 201 of the toilet room.

Figure 6A:
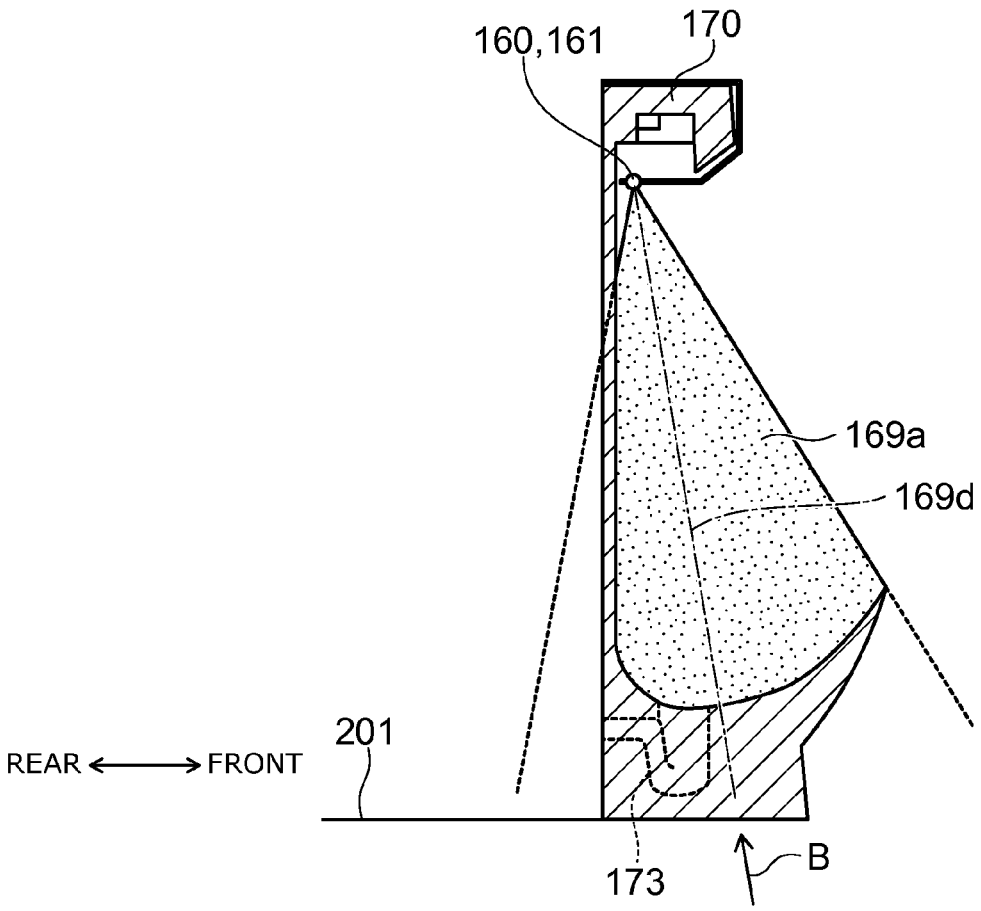
FIGS. 6A and 6B are schematic views describing an alternative shape of water jetted by the second water supplying device of this embodiment.
Figure 6B:
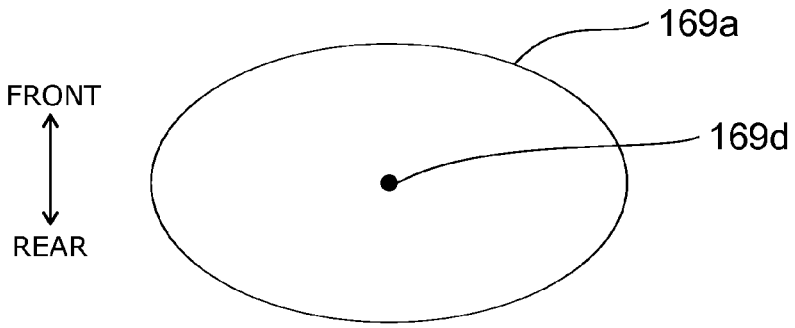

FIGS. 6A and 6B are schematic views describing an alternative shape of water jetted by the second water supplying device of this embodiment.

FIG. 6A is a schematic sectional view of the urinal apparatus of this embodiment as viewed from the lateral side. FIG. 6B is a schematic plan view of water jetted by the second water supplying device as viewed in the direction of arrow B shown in FIG. 6A.

As shown in FIGS. 6A and 6B, the water jetted from the spray sprinkling section 161 of the second water supplying device 160 has a sectoral shape 169*a*. The sprinkling section 161 of the second water supplying device 160 sprinkles water toward the inside of the bowl section 171. In other words, the water sprinkled from the sprinkling section 161 of the second water supplying device 160 is directed toward the inside of the bowl section 171. Specifically, the axis 169*d* of the water of the sectoral shape 169*a* sprinkled from the sprinkling section 161 of the second water supplying device 160 is directed generally downward as viewed from the spray sprinkling section 161. The rest of the jetting configuration is similar to the jetting configuration described above with reference to FIGS. 5A and 5B.

This can reduce the sprinkling amount onto the wall surface of the urinal 170 (the water moving on the surface of the bowl section 171), and maximize sprinkling into the space. Thus, deodorization of odorous components existing in the space can be maximized relative to flushing of the ammonia source originating from urine attached to the surface of the bowl section 171.

In the jetting configuration shown in FIGS. 5A to 6B, the water sprinkled from the sprinkling section 161 dissolves ammonia generated from the trap section 173. Furthermore, the sprinkled water may be functional water containing hypochlorous acid. In this case, the sprinkled water decomposes ammonia into odorless substances in addition to dissolving ammonia. This makes the user less likely to feel the odor of ammonia generated from the trap section 173.

Figure 7A:
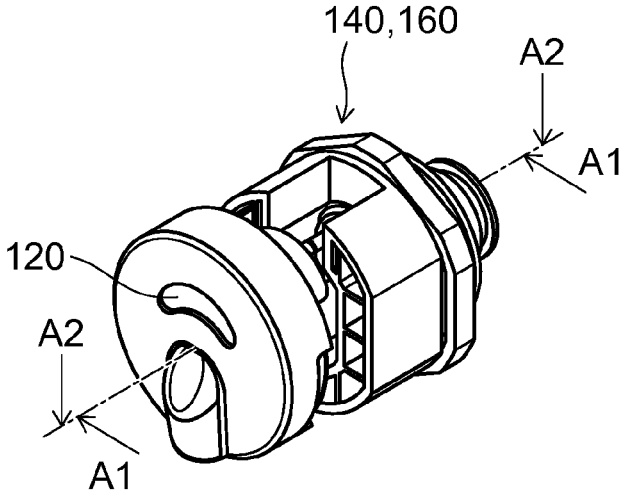
FIGS. 7A to 7C are schematic views illustrating a specific example of the first water supplying device and the second water supplying device of this embodiment.
Figure 7B:
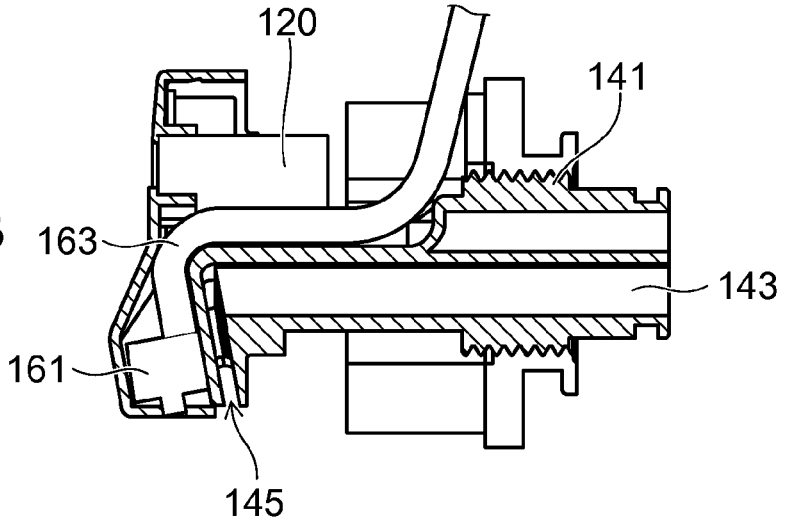
Figure 7C:
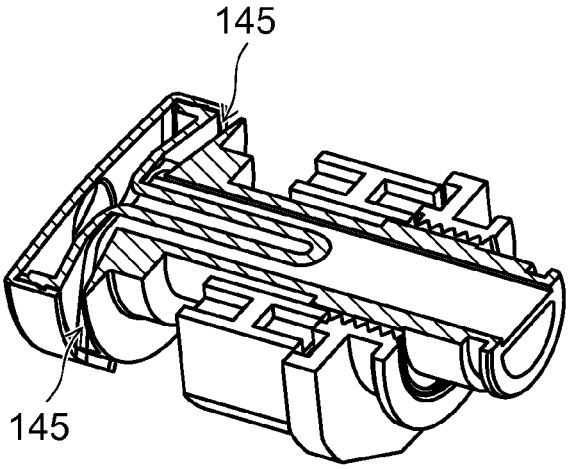

FIGS. 7A to 7C are schematic views illustrating a specific example of the first water supplying device and the second water supplying device of this embodiment.

FIG. 7A is a schematic perspective view illustrating a specific example of the first water supplying device and the second water supplying device. FIG. 7B is a schematic sectional view taken along section A1-A1 shown in FIG. 7A. FIG. 7C is a schematic sectional view taken along section A2-A2 shown in FIG. 7A.

In the specific example shown in FIGS. 7A to 7C, the first water supplying device 140 and the second water supplying device 160 are integrated with each other. As shown in FIG. 7B, the first water supplying device 140 includes a spreader 141. A spreader channel 143 is provided inside the spreader 141. As shown in FIGS. 7B and 7C, a jetting port 145 is formed at one end of the spreader channel 143. The water guided through the spreader channel 143 is jetted from the jetting port 145 and supplied to the bowl section 171 of the urinal 170.

The second water supplying device 160 includes a sprinkling section 161 and a tube 163. The sprinkling section 161 includes e.g. a nozzle, and is connected to one end of the tube 163. The water or functional water guided through the tube 163 is sprinkled as water droplets or functional water droplets from the sprinkling section 161 and supplied to the bowl section 171 of the urinal 170.

As shown in FIGS. 7A and 7B, a human body sensing device 120 is provided inside the first water supplying device and the second water supplying device of this specific example. The human body sensing device 120 is as described above with reference to FIG. 1.

This embodiment is not limited to the first water supplying device 140 and the second water supplying device 160 integrated with each other.

Figure 8:
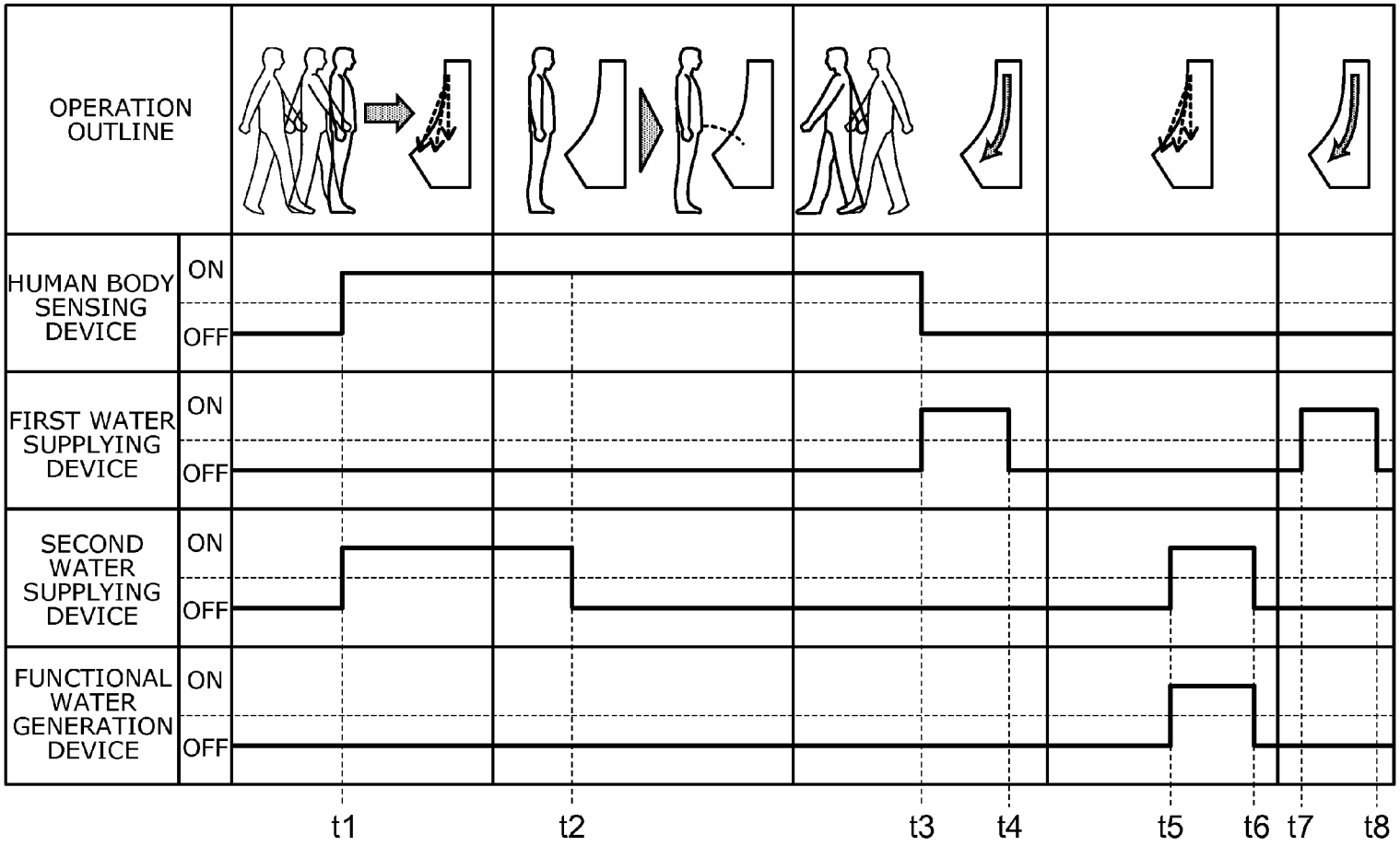
FIG. 8 is a tinning chart illustrating the operation of the urinal apparatus according to this embodiment.

FIG. 8 is a timing chart illustrating the operation of the urinal apparatus according to this embodiment.

First, the human body sensing device 120 senses a user before the urinal 170. Then, the control section 110 controls the operation of the second water supplying device 160 to supply water from the sprinkling section 161 of the second water supplying device 160 to the bowl section 171 (timing t1). That is, the second water supplying device 160 supplies water from the sprinkling section 161 to the bowl section 171 before the user approaches and uses the urinal 170 (timing t1).

Next, the human body sensing device 120 senses the user coming to rest before the urinal 170. Then, the control section 110 controls the operation of the second water supplying device 160 to stop water sprinkled from the sprinkling section 161 (timing t2). Alternatively, the control section 110 may stop water sprinkled from the sprinkling section 161 based on the amount of water sprinkled from the sprinkling section 161, rather than based on the signal indicating that the human body sensing device 120 senses the user coming to rest before the urinal 170.

The designation "ON" regarding the second water supplying device 160 shown in FIG. 8 represents the operation or state in which the second water supplying device 160 supplies water to the bowl section 171. The designation "OFF" regarding the second water supplying device 160 shown in FIG. 8 represents the operation or state in which the second water supplying device 160 does not supply water to the bowl section 171.

Next, the user finishes urination. The human body sensing device 120 senses the user moving away from before the urinal 170. Then, the control section 110 controls the operation of the first water supplying device 140 to supply water from the spreader 141 of the first water supplying device 140 to the bowl section 171 (timing t3). A prescribed amount of water is supplied to the bowl section 171. Then, the control section 110 controls the operation of the first water supplying device 140 to stop water supplied from the spreader 141 (timing t4).

The designation "ON" regarding the first water supplying device 140 shown in FIG. 8 represents the operation or state in which the first water supplying device 140 supplies water to the bowl section 171. The designation "OFF" regarding the first water supplying device 140 shown in FIG. 8 represents the operation or state in which the first water supplying device 140 does not supply water to the bowl section 171.

Next, the human body sensing device 120 senses that the user is no longer located before the urinal 170. Then, the control section 110 controls the operation of the functional water generation device 150 and the second water supplying device 160. Thus, functional water is generated in the functional water generation device 150 and supplied from the sprinkling section 161 of the second water supplying device 160 to the bowl section 171 (timing t5). A prescribed amount of functional water is supplied to the bowl section 171. Then, the control section 110 controls the operation of the functional water generation device 150 and the second water supplying device 160 to stop functional water sprinkled from the sprinkling section 161 (timing t6).

Next, a prescribed time elapses after the first water supplying device 140 supplies water to the bowl section 171 (timing t3). Then, the control section 110 controls the operation of the first water supplying device 140 to supply water from the spreader 141 of the first water supplying device 140 to the bowl section 171 (timing t7). A prescribed amount of water is supplied to the bowl section 171. Then, the control section 110 controls the operation of the first water supplying device 140 to stop water supplied from the spreader 141 (timing t8). This can replace the seal water inside the trap section 173 of the urinal 170 by the newly supplied water.

The operation of timings t7-t8 may be performed when a prescribed time has elapsed after the first water supplying device 140 has supplied water to the bowl section 171 (timing t4). Alternatively, the operation of timings t7-t8 may be performed when a prescribed time has elapsed after the second water supplying device 160 supplies functional water to the bowl section 171 (timing t5). Alternatively, the operation of timings t7-t8 may be performed when a prescribed time has elapsed after the second water supplying device 160 has supplied functional water to the bowl section 171 (timing t6).

Thus, the timing at which the second water supplying device 160 supplies water from the sprinkling section 161 to the bowl section 171 to dissolve and decompose ammonia is different from the timing at which the first water supplying device 140 supplies water to the bowl section 171. This can efficiently suppress the odor of ammonia generated from the urinal apparatus 100.

As described above with reference to the operation at timing t1, the second water supplying device 160 supplies water from the sprinkling section 161 to the bowl section 171 before the user approaches and uses the urinal 170. Thus, the second water supplying device 160 can supply water to the bowl section 171 and suppress the odor of ammonia gas before the user approaches the urinal 170 and feels the odor of ammonia gas. Here, the number of use times of the urinal 170 may be a certain level or more. That is, the urinal 170 may be consecutively used at a certain time interval. In this case, for instance, the effect of the supply of functional water from the second water supplying device 160 by the operation of timings t5-t6 of the previous user is comparable to the effect of the supply of functional water from the second water supplying device 160 by the operation of timings t1-t2 for the user at this time. Thus, it is possible to omit one of the supply of functional water at timings t1-t2 and the supply of functional water at timings t5-t6. Furthermore, advantageously, omission of the supply of functional water from the second water supplying device 160 by the operation of t1-t2 can ensure that the user using the urinal 170 at this time is prevented from being wetted with the sprinkled functional water.

The operation of the urinal apparatus 100 described with reference to FIG. 8 is illustrative only, and is not limited thereto.

Next, an example result of the investigation performed by the inventor is described with reference to the drawings.

Figure 9:
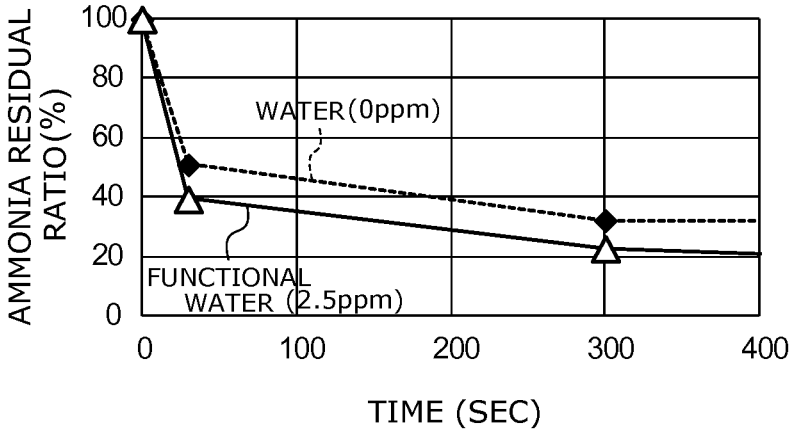
FIG. 9 is a graph showing an example result of an investigation performed by the inventor.

FIG. 9 is a graph showing an example result of an investigation performed by the inventor.

The inventor put artificial urine (warm ammonia water) in a box having a volume of 0.6 cubic meters ($m^3$). Water and functional water were sprinkled into the box from a nozzle attached to the box. The inventor used a liquid containing hypochlorous acid as the functional water. The concentration of hypochlorous acid is approximately 2.5 ppm (parts per million).

The vertical axis of the graph shown in FIG. 9 represents the residual ratio (%) of ammonia in the box. The horizontal axis of the graph shown in FIG. 9 represents elapsed time (seconds) after sprinkling water and functional water into the box. In the graph shown in FIG. 9, the residual ratio of ammonia before sprinkling water and functional water into the box is set to 100 percent (%).

The progression of the residual ratio of ammonia in the box after sprinkling water and functional water is as shown in FIG. 9. More specifically, when water is sprinkled into the box, ammonia in the box is dissolved into the water. When functional water is sprinkled into the box, ammonia in the box is dissolved into the functional water. It is thus found that water and functional water can dissolve and remove ammonia in a relatively short time. It is found that functional water can dissolve and remove a larger amount of ammonia than water (here, fresh water). This is because ammonia is decomposed into an odorless substance called chloramine. That is, the deodorization effect of functional water for ammonia is higher than the deodorization effect of water (here, fresh water) for ammonia.

Figure 10:
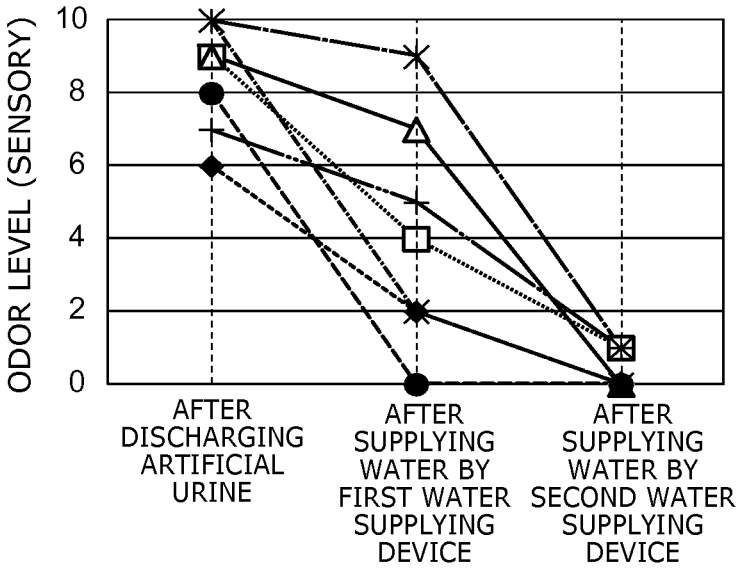
FIG. 10 is a graph showing an example result of an alternative investigation performed by the inventor.

FIG. 10 is a graph showing an example result of an alternative investigation performed by the inventor.

The inventor put artificial urine (warm ammonia water) in the bowl section 171 of the urinal 170. The inventor performed a sensory evaluation of the level of the odor generated from the bowl section 171. Specifically, the inventor selected seven subjects. The inventor had the seven subjects perform a sensory evaluation of the level of the odor generated from the bowl section 171 in ten levels. The timing of the sensory evaluation is after the artificial urine is put into the bowl section 171 of the urinal 170, after the first water supplying device 140 supplies water to the bowl section 171, and after the second water supplying device 160 supplies water to the bowl section 171.

The result of this investigation is as shown in FIG. 10. More specifically, the water supplied from the first water supplying device 140 to the bowl section 171 flushes urine attached to the surface of the bowl section 171. This can lower the level of the odor generated from the bowl section 171. The water supplied from the second water supplying device 160 dissolves ammonia generated inside the bowl section 171. This can further lower the level of the odor generated from the bowl section 171.

Figure 11A:
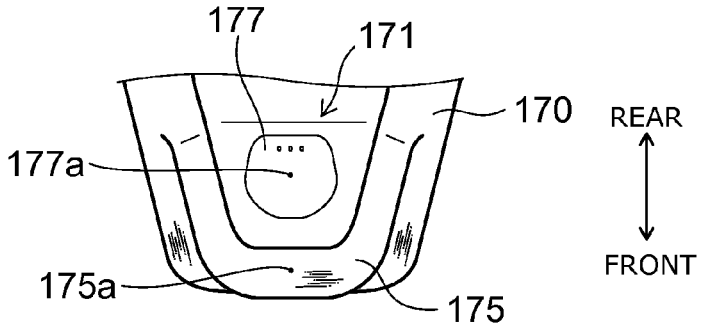
FIGS. 11A to 11C are graphs showing an example result of a further alternative investigation performed by the inventor.
Figure 11B:
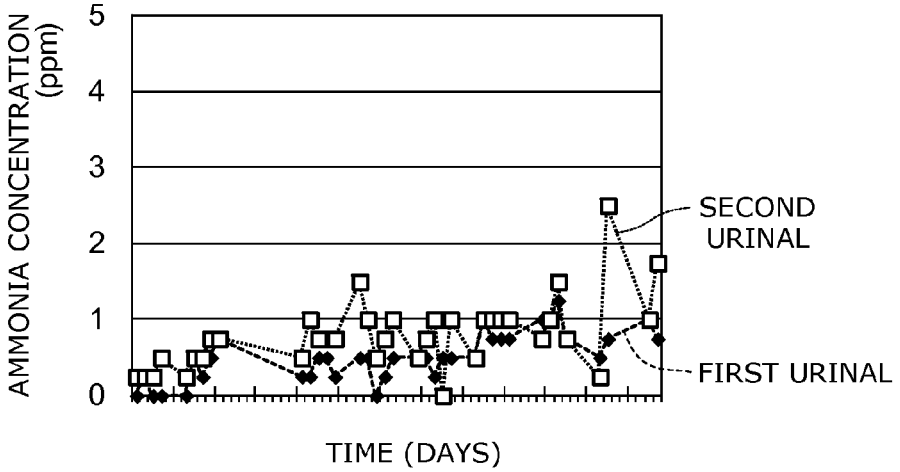
Figure 11C:
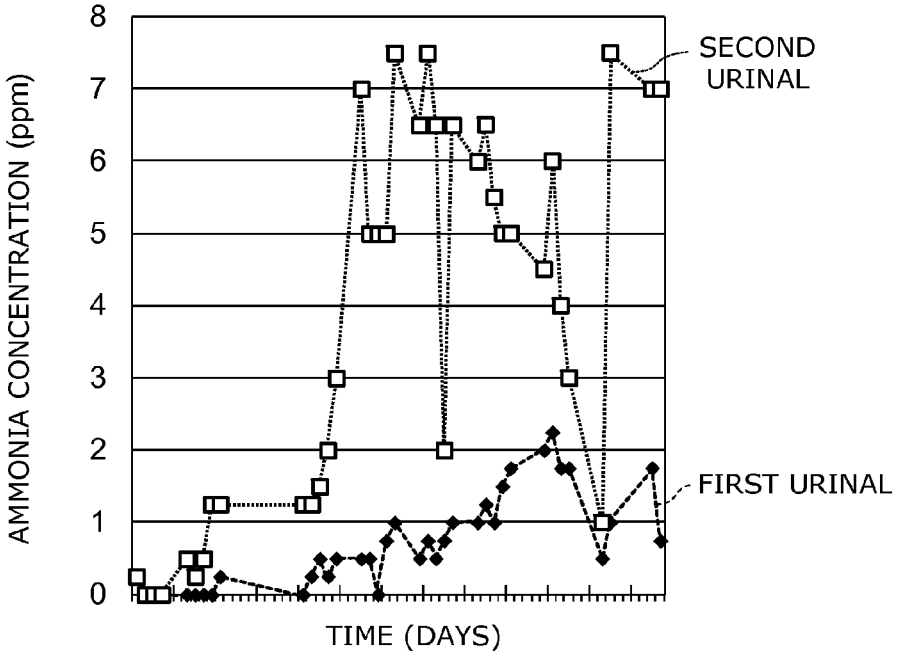

FIGS. 11A to 11C are graphs showing an example result of a further alternative investigation performed by the inventor.

FIG. 11A is a schematic perspective view describing measurement positions of the concentration of ammonia. FIG. 11B is a graph illustrating the progression of the concentration of ammonia at a first position. FIG. 11C is a graph illustrating the progression of the concentration of ammonia at a second position.

The inventor measured the concentration of ammonia of the bowl section 171 of the urinal 170 for approximately two months. Specifically, the inventor measured the concentration of ammonia at two positions 177*a* and 175*a* at a frequency of approximately once a day for approximately two months. The first position 177*a* is located at approximately 10 millimeters (mm) above the strainer 177 provided in the bowl section 171. The second position 175*a* is located at approximately 10 mm above the tip of the lip section 175.

The inventor performed this investigation using two urinals 170. In the first urinal 170*a*, the first water supplying device 140 does not supply water to the bowl section 171. The second water supplying device 160 supplies functional water to the bowl section 171. The functional water contains hypochlorous acid at a concentration of approximately 2.5 ppm. In the second urinal 170*b*, the first water supplying device 140 and the second water supplying device 160 do not supply water to the bowl section 171.

In the first urinal 170*a*, the second water supplying device 160 sprinkles functional water to the bowl section 171 each time the first urinal 170*a* is used. The amount of water supplied to the bowl section 171 by the second water supplying device 160 is approximately 60 mL at a time. The inventor flushed the first urinal 170*a* and the second urinal 170*b* with toilet detergent before starting this investigation. The inventor measured the concentration of ammonia using a sensor tube.

The progression of the concentration of ammonia in the first urinal 170*a* and the second urinal 170*b* is as shown in FIGS. 11B and 11C. More specifically, the concentration of ammonia at the first position 177*a* and the second position 175*a* increases when the first water supplying device 140 and the second water supplying device 160 do not supply water to the bowl section 171 (second urinal 170*b*). Even when the first water supplying device 140 does not supply water to the bowl section 171, the increase of the concentration of ammonia at the first position 177*a* and the second position 175*a* can be suppressed when the second water supplying device 160 supplies water or functional water to the bowl section 171 (first urinal 170*a*).

Figure 12A:
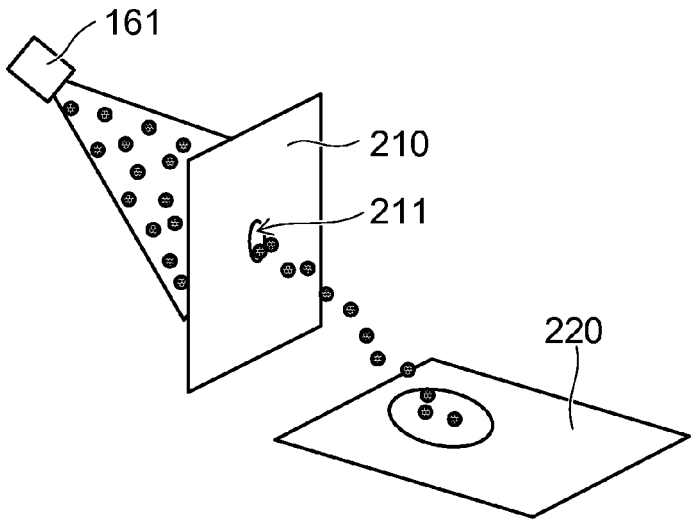
FIGS. 12A and 12B are graphs showing an example result of a further alternative investigation performed by the inventor.
Figure 12B:
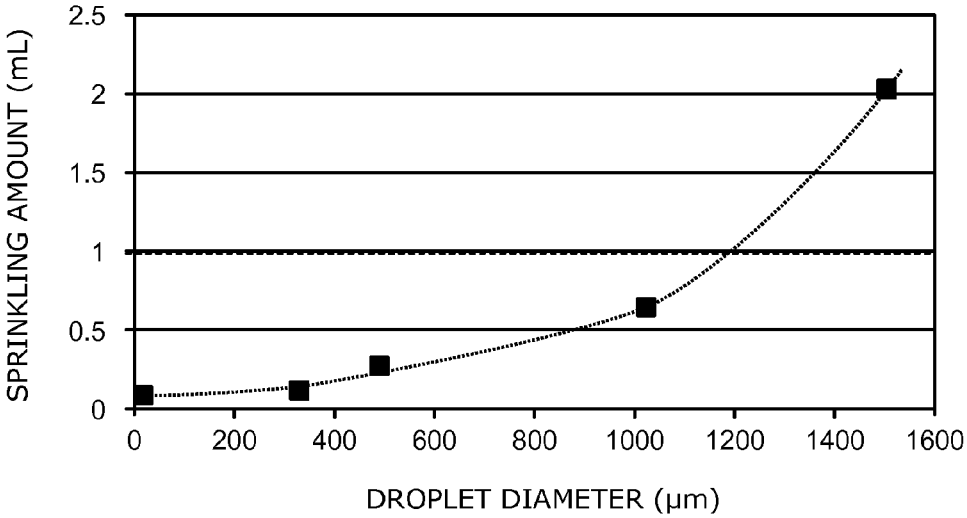

FIGS. 12A and 12B are graphs showing an example result of a further alternative investigation performed by the inventor.

FIG. 12A is a schematic perspective view describing the condition of this investigation. FIG. 12B is a graph showing the sprinkling amount of water versus the diameter of the water droplet.

The vertical axis of the graph shown in FIG. 12B represents the sprinkling amount (mL). The horizontal axis of the graph shown in FIG. 12B represents the diameter of the water droplet (μm).

The inventor performed an investigation in a principle model environment regarding the difference in the sprinkling amount of water due to the difference in the diameter of the water droplets sprinkled by the sprinkling section 161. More specifically, the inventor prepared a plate 210 having a hole 211, and a water-sensitive paper 220. The diameter of the hole 211 is approximately 20 mm. As shown in FIG. 12A, the inventor placed the sprinkling section 161 on one side of the plate 210, and placed the water-sensitive paper 220 on the other side of the plate 210. Under the condition shown in FIG. 12A, the inventor sprinkled water droplets from the sprinkling section 161. The inventor measured the amount of water attached to the water-sensitive paper 220.

The amount of water attached to the water-sensitive paper 220 (sprinkling amount) is as shown in FIG. 12B. More specifically, the amount of water attached to the water-sensitive paper 220 is smaller than 1 mL in the case where the diameter of the water droplets sprinkled by the sprinkling section 161 is 10 μm or more and 1200 μm or less. On the other hand, the amount of water attached to the water-sensitive paper 220 is 1 mL or more in the case where the diameter of the water droplets sprinkled by the sprinkling section 161 is 1500 μm.

Here, according to the knowledge obtained by the inventor, sprinkling of water can be perceived in the actual urinal installation environment in the case where the amount of water attached to the water-sensitive paper 220 (sprinkling amount) is 1 mL or more. Thus, the diameter of the water droplet is preferably 1200 μm or less to prevent the user from perceiving sprinkling of water to the user or the floor.

In the case where the diameter of the water droplet is smaller than 10 μm, the water droplet is more likely to drift or float in the space. Thus, the diameter of the water droplet is preferably 10 μm or more to prevent the user from perceiving sprinkling of water to the user or the floor.

The embodiment of the invention has been described above. However, the invention is not limited to the above description. Those skilled in the art can suitably modify the above embodiment, and such modifications are also encompassed within the scope of the invention as long as they include the features of the invention. For instance, the shape, dimension, material, layout and the like of various components in e.g. the first water supplying device 140 and the second water supplying device 160, and the installation configuration and the like of the first water supplying device 140 and the second water supplying device 160 are not limited to those illustrated, but can be suitably modified.

Furthermore, various components in the above embodiment can be combined with each other as long as technically feasible. Such combinations are also encompassed within the scope of the invention as long as they include the features of the invention.

What is claimed is:

1. A urinal apparatus comprising:

a water supplying device configured to supply water to a back surface of a bowl section of a urinal for removing urine attached to the back surface of the bowl section of the urinal including a portion of the back surface in an upper part of the bowl section of the urinal configured to face a user; and a water sprinkling device configured to sprinkle water droplets downward from the upper part of the bowl section through a space between the upper part of the bowl section and a lower part of the bowl section, each of the water droplets having a diameter of 10 micrometers or more and 1200 micrometers or less, wherein the bowl section includes a front surface in the lower part of the bowl section and the back surface, the back surface including a portion in the lower part of the bowl section and the portion in the upper part of the bowl section, the front surface opposing the portion of the back surface in the lower part of the bowl section and the lower part including a region of the bowl section that includes an imaginary plane intersecting a lip section and the back surface.

2. The apparatus according to claim 1, wherein the water sprinkling device includes a sprinkling section provided in the upper part, the water sprinkled by the sprinkling section is shaped like a cone or a sector, and the water sprinkled by the sprinkling section ranges inside the bowl section.

3. The apparatus according to claim 2, wherein the cone or the sector has an axis directed behind the urinal.

4. The apparatus according to claim 1, wherein the water sprinkled by the water sprinkling device is functional water capable of decomposing ammonia.

5. A urinal apparatus comprising:

a first water supplying device configured to supply water to a back surface of a bowl section of a urinal for removing urine attached to the back surface of the bowl section of the urinal including a portion of the back surface in an upper part of the bowl section of the urinal configured to face a user; and a second water supplying device configured to sprinkle water in a smaller amount than the water supplied by the first water supplying device, the second water supplying device sprinkling the water through a space above a lower part of the bowl section and to at least part of a first region of the bowl section not flushed with the water supplied by the first water supplying device, wherein the bowl section includes a front surface in the lower part of the bowl section and the back surface, the back surface including a portion in the lower part of the bowl section and a portion above the lower part of the bowl section, the portion of the back surface in the lower part of the bowl section opposing the front surface and the lower part including a second region of the bowl section that includes an imaginary plane intersecting a lip section and the back surface.

6. The apparatus according to claim 5, wherein the first region includes a lateral side of a spreader.

7. The apparatus according to claim 5, wherein the first region includes a tip part of the lip section of the urinal.

8. The apparatus according to claim 5, wherein the water supplied from the second water supplying device and moving on one surface of the bowl section has a slower speed than the water supplied from the first water supplying device and moving on another surface of the bowl section.

9. The apparatus according to claim 5, wherein the second water supplying device supplies water droplets to the bowl section.

* * * * *